US008460007B1

(12) United States Patent
Xie et al.

(10) Patent No.: US 8,460,007 B1
(45) Date of Patent: Jun. 11, 2013

(54) SOCKET CONNECTOR

(75) Inventors: Bao-Geng Xie, New Taipei (TW); Wei-Hong Liao, New Taipei (TW); Ming-Chiang Chen, New Taipei (TW)

(73) Assignee: Cheng Uei Precision Industry Co., Ltd., New Taipei ( * ) Notice: Subject to any disclaimer, the term of this patent is extended or adjusted under 35 U.S.C. 154(b) by 0 days.

(21) Appl. No.: 13/316,444

(22) Filed: Dec. 9, 2011

(51) Int. Cl.
*H01R 11/30* (2006.01)

(52) U.S. Cl.
USPC ..... 439/39; 439/289

(58) Field of Classification Search
USPC ..... 439/25, 39, 289, 389, 862
See application file for complete search history.

(56) References Cited

U.S. PATENT DOCUMENTS 5,865,648 A * 2/1999 Clyatt, III ..... 439/620.09
6,203,335 B1 * 3/2001 Chang ..... 439/79
7,258,571 B1 * 8/2007 Chen ..... 439/500
7,261,579 B2 * 8/2007 Ku et al. ..... 439/289
7,497,693 B1 * 3/2009 Wu ..... 439/39
7,497,733 B1 * 3/2009 Van der Steen ..... 439/607.01
7,566,224 B2 * 7/2009 Wu ..... 439/39
7,891,991 B2 * 2/2011 Zhang ..... 439/79
8,047,857 B1 * 11/2011 Lu et al. ..... 439/83
8,123,551 B1 * 2/2012 Liu et al. ..... 439/500
8,303,353 B2 * 11/2012 Zhu ..... 439/862

* cited by examiner

*Primary Examiner* — Thanh Tam Le

(57) ABSTRACT

A socket connector includes an insulating body having a base body and a holding body extending upward from a front of the base body. The holding body defines a terminal fillister spread to the base body. A plurality of openings is opened in a front face of the holding body and communicates with the terminal fillister. A terminal group molding in the terminal fillister of the insulating body has a plurality of elastic touching arms stretching outside the insulating body, and a plurality of contact slices exposed through the openings respectively. A magnetic body defines a window. The magnetic body is mounted to a front of the insulating body with the window facing the openings to further expose the contact slices therethrough. The terminal group has a ground terminal elastically projecting forward out of the insulating body to electrically abut against a rear face of the magnetic body.

6 Claims, 4 Drawing Sheets

SOCKET CONNECTOR

BACKGROUND OF THE INVENTION

1. Field of the Invention

The present invention relates to a socket connector, and more particularly to a socket connector adapted for connecting with a plug connector by virtue of magnetic attraction.

2. The Related Art

Nowadays, with the development of electronic technology, electronic products and peripheral devices thereof are connected with each other more and more frequently. And it is a kind of common connection way to realize an electrical connection between the electronic product and its peripheral device by virtue of a connector assembly. The connector assembly includes a socket connector and a plug connector located in the electronic product and its peripheral device respectively, and mated with each other by some means such as magnetic attraction. In detail, the socket connector and the plug connector are provided with magnet blocks therein so as to make the socket connector and the plug connector steadily attract with each other. However, the magnet blocks are fastened in the socket connector generally by glue, so that needs a complicated assembly procedure and an expensive cost of manufacture.

SUMMARY OF THE INVENTION

Accordingly, an object of the present invention is to provide a socket connector. The socket connector includes an insulating body having a base body and a holding body extending upward from a front of the base body. The holding body defines a terminal fillister spread to the base body. A plurality of openings is opened in a front face of the holding body and communicates with the terminal fillister. A terminal group molding in the terminal fillister of the insulating body has a plurality of elastic touching arms stretching outside the insulating body, and a plurality of contact slices exposed through the openings respectively. A magnetic body defines a window. The magnetic body is mounted to a front of the insulating body with the window facing the openings to further expose the contact slices therethrough. The terminal group has a ground terminal elastically projecting forward out of the insulating body to electrically abut against a rear face of the magnetic body.

As described above, the socket connector of the present invention makes the magnetic body mounted to the front of the insulating body by means of assembling manner. So, the socket connector has a simple assembly procedure and a low manufacture cost.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
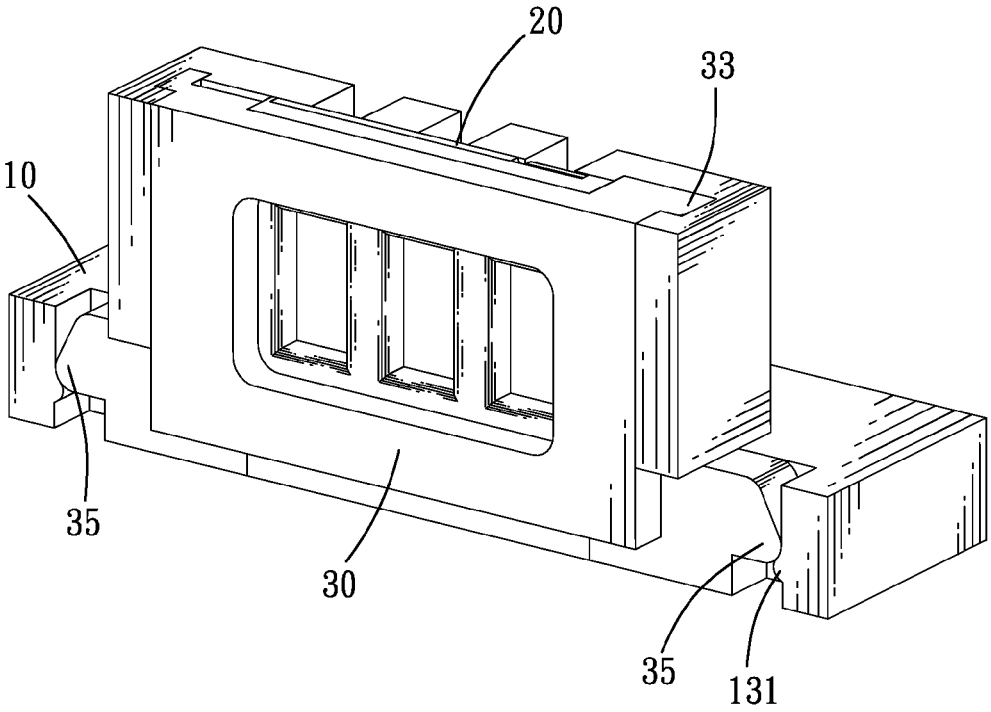
FIG. 1 is an assembled, perspective view of a socket connector in accordance with an embodiment of the present invention.
Figure 2:
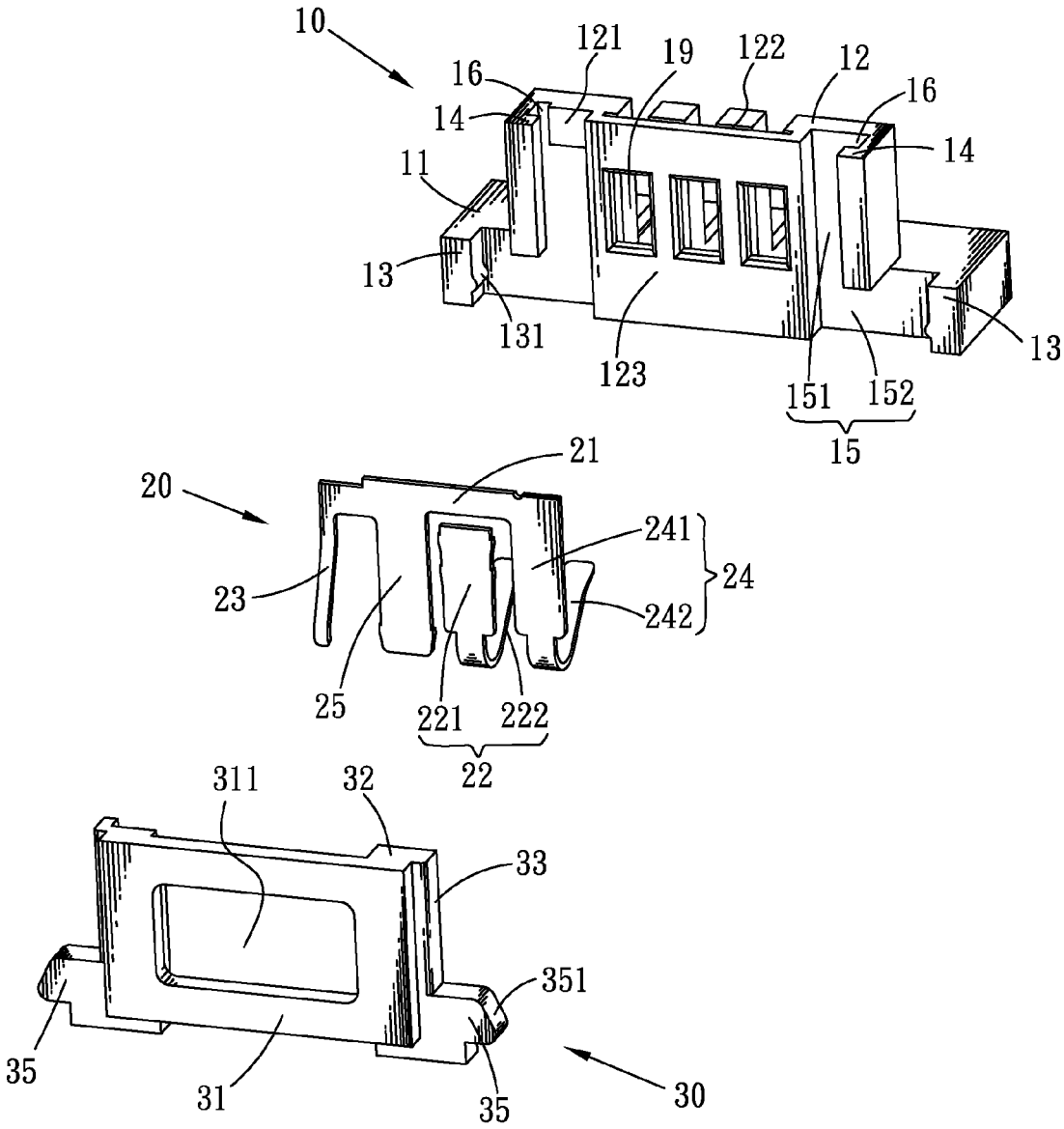
FIG. 2 and FIG. 3 are exploded, perspective views of the socket connector shown in FIG. 1.

Referring to FIGS. 1-2, a socket connector according to an embodiment of the present invention includes an insulating body 10, a terminal group 20 molding in the insulating body 10, and a magnetic body 30 mounted to the insulating body 10.

Figure 3:
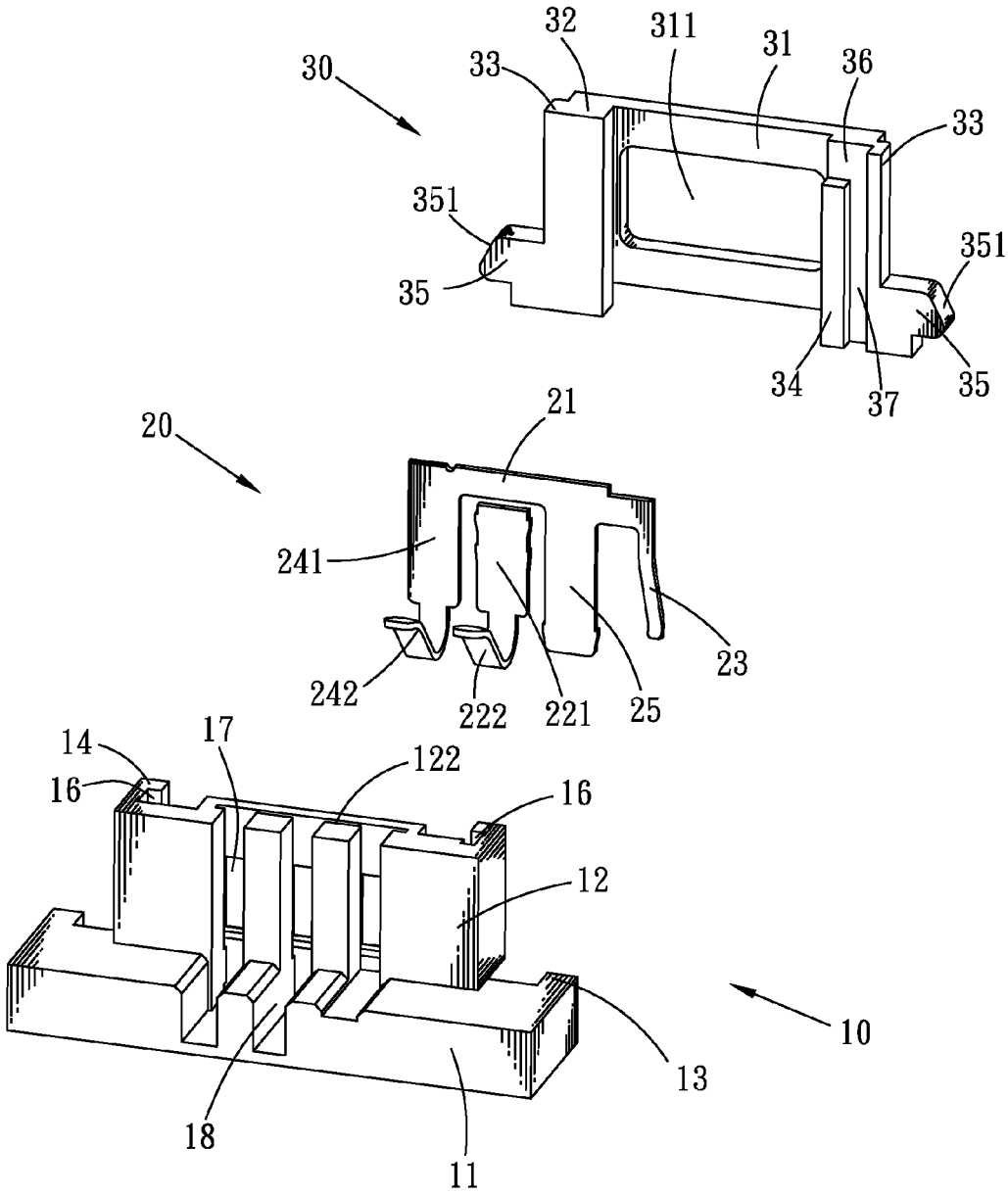
Figure 4:
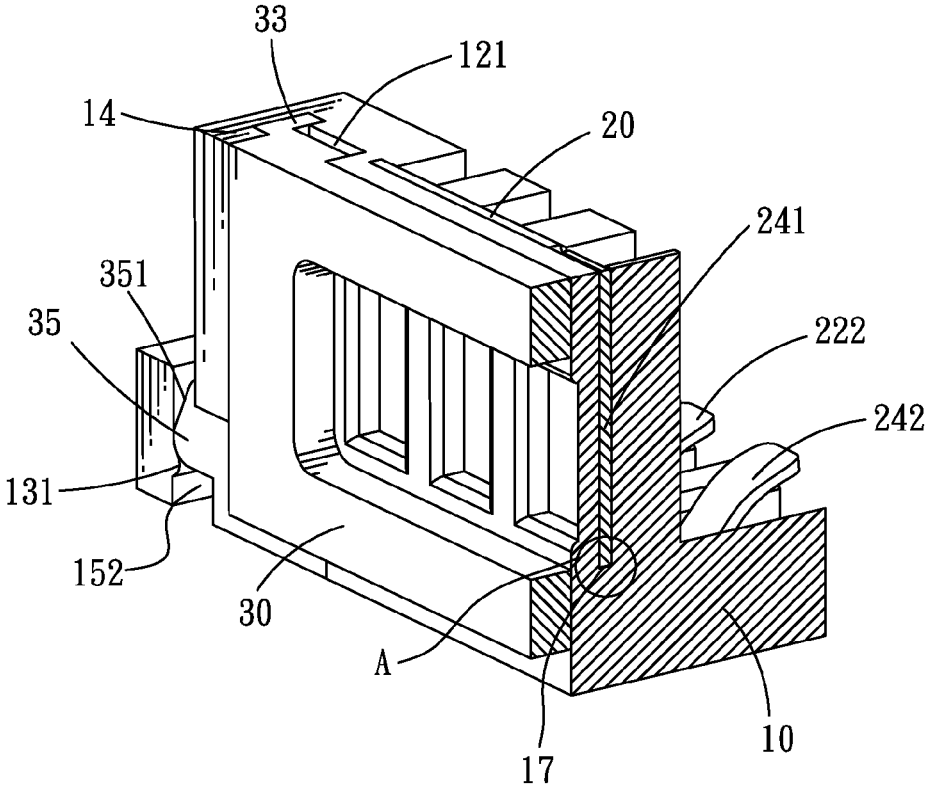
FIG. 4 is a sectional, perspective view of the socket connector of FIG. 1.
Figure 5:
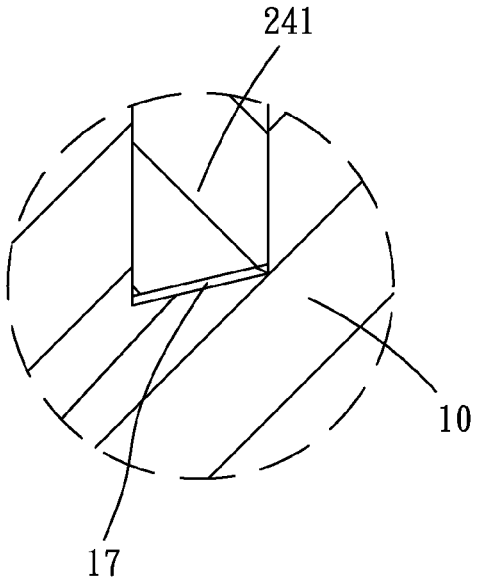
FIG. 5 is an enlarged view of an encircled part A of the socket connector shown in FIG. 4.

With reference to FIG. 2, FIG. 3 and FIG. 5, the insulating body 10 has a rectangular base body 11, and a holding body 12 extending upward from a middle of a front of the base body 11. Two sides of a front of the insulating body 10 are cut off to define a pair of L-shaped receiving grooves 15 of which each includes a first receiving groove 151 vertically opened in the holding body 12 and a second receiving groove 152 horizontally opened in the base body 11. The second receiving groove 152 has one inner end connected with a bottom of the first receiving groove 151, and has a bottom opened freely. A pair of holding blocks 13 protrudes forward at two outmost ends of the second receiving grooves 152. An inner side of each holding block 13 protrudes inward to form a holding rib 131 of a substantial semi-cylinder shape extending along a front-to-rear direction. A pair of L-shaped holding portions 14 protrudes forward at two outmost sides of the first receiving grooves 151, and each extends vertically over the second receiving groove to define a holding channel 16 between the holding portion 14 and a rear inside of the first receiving groove 151. The holding channel 16 communicates with the first receiving groove 151 and the second receiving groove 152. An upper portion of the rear inside of one of the first receiving grooves 151 protrudes forward to form a blocking block 121 apart from the corresponding holding portion 14. The holding body 12 defines a terminal fillister (not labeled) spread to the base body 11. A plurality of openings 19 is opened in a front face 123 of the holding body 12 between the first receiving grooves 151, and communicates with the terminal fillister. The terminal fillister includes an inserting slot 122 opened in a top of the holding body 12, a plurality of fastening slots 17 apart concaved downward from a bottom side of the inserting slot 122 and correspondingly opened behind the openings 19 to further connect with the corresponding openings 19, and a plurality of receiving passages 18 opened in a rear of the base body 11 and each extending along a front-to-rear direction to connect with a bottom of the corresponding fastening slot 17. The receiving passages 18 further penetrate through a top side of the base body 11.

Referring to FIGS. 2-3, the terminal group 20 includes a ground terminal 23 and a power terminal 24 formed at two ends of a bottom edge of a base strip 21. The ground terminal 23 extends downward from one end of the bottom edge of the base strip 21 and is inclined forward in process of extending downward. The power terminal 24 has a contact slice 241 extending downward from the other end of the bottom edge of the base strip 21, and an elastic touching arm 242 bending rearward and inclining upward from a bottom end of the contact slice 241. The terminal group 20 further includes a fixing terminal 25 of a rectangular slice shape extending downward from the bottom edge of the base strip 21 and located between the ground terminal 23 and the contact slice 241 of the power terminal 24. The terminal group 20 further includes a signal terminal 22 independent of the ground terminal 23, the power terminal 24 and the fixing terminal 25. The signal terminal 22 has a structure similar to that of the power terminal 24, and has a contact slice 221 and an elastic touching arm 222.

Referring to FIGS. 1-4, the terminal group 20 is molded in the terminal fillister of the insulating body 10, with the base strip 21 clipped in the inserting slot 122. The contact slices 241, 221 and the fixing terminal 25 are embedded in the fastening slots 17 and further exposed through the corresponding openings 19, and the elastic touching arms 242, 222 elastically project upward out of the corresponding receiving passages 18 behind the holding body 12, wherein the signal terminal 22 is located between the power terminal 24 and the fixing terminal 25. The ground terminal 23 elastically projects forward in the one first receiving groove 151.

Referring to FIGS. 1-4, the magnetic body 30 is made of magnetic metal material, and has a base board 31 disposed vertically. Two opposite sides of the base board 31 extend rearward to form two side walls 32. Rears of two opposite outer sides of the side walls 32 oppositely protrude sideward to form a pair of holding latches 33 each extending vertically at an upper portion thereof, and a pair of holding ears 35 at bottoms thereof. A free end of each holding ear 35 has a top corner cut off to define a guiding slope 351 slantwise and smoothly connecting a top side and a bottom side of the holding ear 35. A rear face of one side wall 32 defines a receiving gap 36 opened at a top thereof, and a receiving channel 37 extending vertically to penetrate through a bottom thereof. A blocking rib 34 is formed under the receiving gap 36 and extends vertically adjacent to the receiving channel 37.

The magnetic body 30 is pushed upward to be assembled to the front of the insulating body 10 by means of the cooperation and guidance between the side walls 32 and the first receiving grooves 151 and between the holding latches 33 and the holding channels 16, until the blocking rib 34 resists against a bottom of the blocking block 121. At this time, the blocking block 121 is positioned in the receiving gap 36, and the holding ears 35 are held in the second receiving grooves 152 by the corresponding holding ribs 131. The base board 31 is covered on the front face 123 of the holding body 12 and a front side of the base body 11, wherein the base board 31 defines a window 311 opened in a substantial middle thereof and facing the openings 19 of the insulating body 10 for further exposing the contact slices 221, 241 of the signal terminal 22 and the power terminal 24 therethrough. The receiving channel 37 communicates with the one first receiving groove 151, and the ground terminal 23 is pressed in the receiving channel 37 to electrically connect with the magnetic body 30. In the process of pushing the magnetic body 30 upward, the holding ears 35 slide over the corresponding holding ribs 131 by virtue of the guidance of the guiding slopes 351 to be held by the holding ribs 131.

As described above, the magnetic body 30 is assembled to the front of the insulating body 10 by virtue of the holding latches 33 being held in the holding channels 16, the blocking rib 34 resisting against the bottom of the blocking block 121, and the holding ears 34 being held by the holding ribs 131. So, the socket connector has a simple assembly procedure and a low manufacture cost.

What is claimed is:

1. A socket connector, comprising:

an insulating body having a base body and a holding body extending upward from a front of the base body, the holding body defining a terminal fillister spread to the base body, a plurality of openings being opened in a front face of the holding body and communicating with the terminal fillister;

a terminal group molding in the terminal fillister of the insulating body, the terminal group having a plurality of elastic touching arms stretching outside the insulating body, and a plurality of contact slices exposed through the openings respectively; and a magnetic body defining a window, the magnetic body being mounted to a front of the insulating body with the window facing the openings to further expose the contact slices therethrough, the terminal group having a ground terminal elastically projecting forward out of the insulating body to electrically abut against a rear face of the magnetic body;

wherein two sides of the front of the insulating body define a pair of L-shaped receiving grooves of which each includes a first receiving groove vertically opened in the holding body and a second receiving groove horizontally opened in the base body and penetrating through a bottom of the base body, the second receiving groove has one inner end thereof connected with a bottom of the first receiving groove, a pair of L-shaped holding portions protrudes forward at two outmost sides of the first receiving grooves, and each extends vertically over the second receiving groove to define a holding channel between the holding portion and a rear inside of the first receiving groove, the magnetic body has a base board covered on a front face of the holding body and a front side of the base body with the window opened in a substantial middle thereof, two opposite sides of the base board extend rearward to form two side walls disposed in the first receiving grooves, rears of two opposite outer sides of the side walls oppositely protrude sideward to form a pair of holding latches each extending vertically at an upper portion thereof to be held in the corresponding holding channel, and a pair of holding ears at bottoms thereof secured in the second receiving grooves, the ground terminal elastically projects forward in one first receiving groove to abut against the rear face of the corresponding side wall of the magnetic body.

2. The socket connector as claimed in claim 1, wherein a pair of holding blocks protrudes forward at two outmost ends of the second receiving grooves, an inner side of each holding block protrudes inward to form a holding rib of a substantial semi-cylinder shape extending along a front-to-rear direction, a free end of each holding ear has a top corner cut off to define a guiding slope slantwise and smoothly connecting a top side and a bottom side of the holding ear, the magnetic body is assembled to the front of the insulating body by means of pushing the magnetic body upward under the cooperation and guidance between the side walls and the first receiving grooves and between the holding latches and the holding channels, the holding ears slide upward over the holding ribs by virtue of the guidance of the guiding slopes to be held by the holding ribs in the second receiving grooves.

3. The socket connector as claimed in claim 2, wherein an upper portion of the rear inside of the one first receiving groove protrudes forward to form a blocking block apart from the holding portion, the rear face of the corresponding side wall defines a receiving gap opened at a top thereof, and a receiving channel extending vertically to penetrate through a bottom thereof, a blocking rib is formed under the receiving gap and extends vertically adjacent to the receiving channel, the blocking rib resists against a bottom of the blocking block when the blocking block is positioned in the receiving gap, the ground terminal is pressed in the receiving channel.

4. The socket connector as claimed in claim 1, wherein the terminal group further includes a power terminal having the contact slice extending downward from one end of a bottom edge of a base strip, and the elastic touching arm bending rearward and inclining upward from a bottom end of the contact slice, the ground terminal extends downward from the other end of the bottom edge of the base strip and is inclined forward in process of extending downward, the terminal group further includes a signal terminal independent of the ground terminal and the power terminal, the signal terminal has a structure similar to that of the power terminal, and has the contact slice and the elastic touching arm, the base strip and the contact slices are embedded in the terminal fillister of the insulating body with the signal terminal located between the ground terminal and the power terminal, the elastic touching arms project beyond a top side of the base body and behind the holding body.

5. The socket connector as claimed in claim 4, wherein the terminal fillister includes an inserting slot opened in a top of the holding body for clipping the base strip of the terminal group therein, a plurality of fastening slots apart concaved downward from a bottom side of the inserting slot and correspondingly opened behind the openings to further connect with the corresponding openings for inserting the contact slices therein, and a plurality of receiving passages opened in a rear of the base body and each extending along a front-to-rear direction to connect with a bottom of the corresponding fastening slot, the receiving passages further penetrate through the top side of the base body, the elastic touching arms project upward out of the receiving passages.

6. The socket connector as claimed in claim 4, wherein the terminal group further includes a fixing terminal of a rectangular slice shape extending downward from the bottom edge of the base strip, the fixing terminal is embedded in the terminal fillister of the insulating body and located between the ground terminal and the contact slice of the signal terminal, the fixing terminal is further exposed through one of the openings of the holding body and the window of the magnetic body.

* * * * *